United States Patent [19]

Wilson et al.

[11] Patent Number: 4,611,449

[45] Date of Patent: Sep. 16, 1986

[54] EXTERIOR EXPANSION JOINT COVER ASSEMBLY

[75] Inventors: Michael D. Wilson; Dale A. Schmitt, both of Oklahoma City, Okla.

[73] Assignee: Metalines, Inc., Oklahoma City, Okla.

[21] Appl. No.: 599,200

[22] Filed: Apr. 11, 1984

[51] Int. Cl.[4] ..... E04B 1/00

[52] U.S. Cl. ..... 52/278; 52/573

[58] Field of Search ..... 52/463, 466, 276, 277, 52/278, 573, 346

[56] References Cited

U.S. PATENT DOCUMENTS

| | | | |
|---|---|---|---|
| 2,917,793 | 12/1959 | Owen | 52/769 X |
| 2,948,994 | 8/1960 | Thom | 52/573 X |
| 3,183,626 | 5/1965 | Schmitt | 52/573 X |
| 3,270,474 | 9/1966 | Driggers | 52/573 X |
| 3,289,372 | 12/1966 | Adams et al. | 52/346 |
| 3,315,428 | 4/1967 | Goldstein | 52/278 |
| 3,331,171 | 7/1967 | Hallock | 52/278 |
| 3,390,501 | 7/1968 | Driggers | 52/278 X |
| 3,683,573 | 8/1972 | Payraudeau et al. | 52/311 X |
| 3,690,076 | 9/1972 | Harris, Jr. | 52/511 X |
| 3,750,359 | 8/1973 | Balzer et al. | 52/573 X |
| 3,864,886 | 2/1975 | Thom | 52/466 X |
| 4,065,901 | 1/1978 | Früh | 52/582 |

FOREIGN PATENT DOCUMENTS

| | | | |
|---|---|---|---|
| 2305565 | 3/1975 | France | 52/346 |

*Primary Examiner*—Alfred C. Perham
*Assistant Examiner*—Jean M. LaKemper
*Attorney, Agent, or Firm*—Laney, Dougherty, Hessin, Claro & Beavers

[57] ABSTRACT

Apparatus for concealment and abridgement of relatively larger expansion joint voids between structures exhibiting orthogonal relative movement. The assembly consists of base plate and slide structure secured in orthogonal disposition on opposite sides of an expansion void, with angular matching cover plate structure supported on said base plate and slide structure.

22 Claims, 12 Drawing Figures

EXTERIOR EXPANSION JOINT COVER ASSEMBLY

BACKGROUND OF THE INVENTION

1. Field of the Invention

The invention relates generally to expansion joint cover assemblies and, more particularly, but not by way of limitation, it relates to cover plate assembly that provides multidimensional relative movement of the adjoining structures.

2. Description of the Prior Art

The prior art includes numerous types of expansion joint assemblies, including cover plate structure, for providing connection between adjoining structures that exhibit relative movement in one direction. Thus, such expansion joint cover assemblies are utilized for floor-to-floor and floor-to-wall installation are well characterized by the U.S. Pat. No. 3,183,626 in the name of Schmitt, and the U.S. Pat. No. 3,270,474 in the name of Driggers. Each of these teachings provide cover for relatively restricted expansion joint spacings as are found in interior structural applications. U.S. Pat. Nos. 3,750,359 and 3,331,171 disclose yet additional teachings showing expansion void covers for right-angle affixure, e.g. for floor-to-wall applications. The present invention is directed to enclosure, including provision for architecturally aesthetic coverage, of larger void spaces that may be existing between adjoining building structures or the like, and wherein such adjoining structures vary in plural dimensions as to relative spacing and position.

Therefore, it is an object of the present invention to provide an exterior cover plate assembly for connection between adjoining building structures.

It is also an object of the present invention to provide a cover plate assembly having three degrees of planar adjustment.

It is still further an object of the present invention to provide an exterior expansion joint and cover plate assembly suitable for aesthetically appealing joinder between tall building structures.

It is yet further an object to provide an expansion assembly for orthoganally oriented surfaces.

Finally, it is an object of the invention to provide an exterior building expansion joint assembly that is weather-tight and provides three degrees of relative movement as between adjoining structures.

Other objects and advantages of the invention will be evident from the following detailed description when read in conjunction with the accompanying drawings which illustrate the invention.

DETAILED DESCRIPTION OF THE INVENTION

Figure 1:
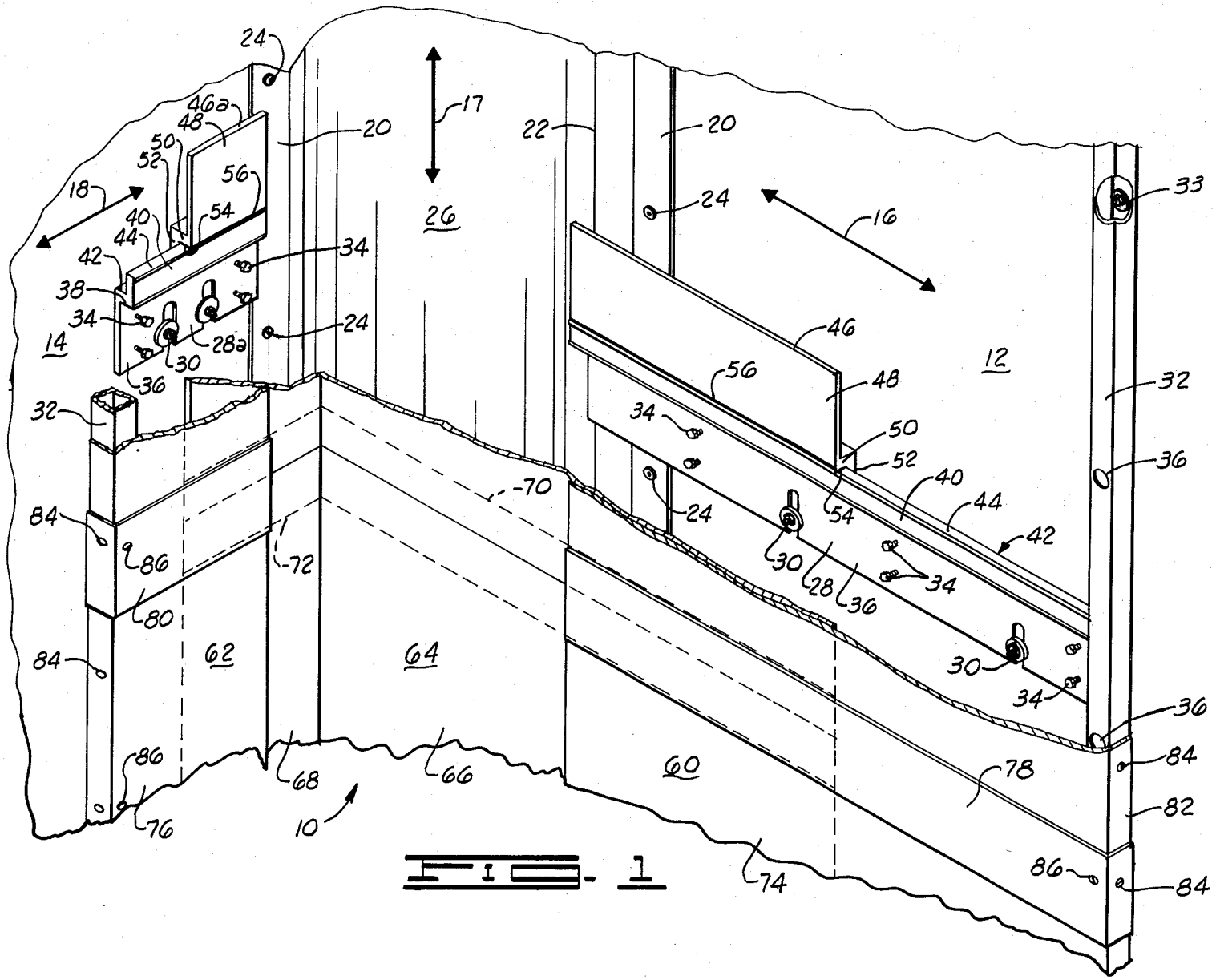
FIG. 1 is a view in perspective of a portion of a flush mount exterior expansion joint assembly, with parts shown in cutaway, as constructed in accordance with the present invention.

FIG. 1 illustrates an expansion joint assembly 10 of the flush mount type which may be installed between a first building structure 12 and a second building structure 14 disposed adjacent thereto. The buildings 12 and 14 may be of quite different height, width, alignment or texture, and each may exhibit a distinctly different sway or movement pattern in response to wind sway or other moving forces. Still, it is often desirable to connect such adjoining buildings, e.g. as when building spaces are enlarged with intention that they cooperate as a single, complete entity, either functionally or architecturally.

As shown in FIG. 1, building 12 abuts against an open wall of building 14, and while allowing for sufficient sway spacing, relative building movement in three directions must be expected. Note arrows 16, 17 and 18, respectively, denoting orthogonal relative building movement. Thus, the individual hanger and cover structure as secured to each of buildings 12 and 14 is essentially the same albeit that it varies in length and spacing in accordance with the necessary expansion movement to be encountered, and the requisite strength requirements needed to counter effects of vertical loading variations. The vertical loads as between buildings 12 and 14 can vary with vertical dimension changes due to settling, differential temperature changes, and the like.

Hanger structure on building 12 consists of a base hold down strip 20 secured adjacent the vertical corner 22 of building 12 along the vertical length as periodically secured by a plurality of masonry fasteners 24. A vinyl gutter 26 is secured across the expansion void space with one side secured along its vertical length between hold down strip 20 and building 12. The opposite side of vinyl gutter 26 is secured by similar structure on building 14, i.e. a base hold down strip 20 and a plurality of masonery fasteners 24 of requisite size and strength.

A plurality of base member slide plates 28 are secured perpendicular to the vertical edge 22 at periodic placement along the height of builing 12. The base slide plates 28 extend from vertical edge 22 outward for a distance equal to the requisite expansion allowance and cover plate width as they are each secured by a plurality of masonry fasteners 30. The outer end of the plurality of base member slide plates 28 is held in retention by a vertical base plate 32, e.g. a channel strip, that is rigidly secured to building 12 by means of a plurality of masonry fasteners 33 accessible through respective holes 36. Base plate 32 may be weld-joined to each respective base slide plate 28 if desired, similar base member structures are further discussed below.

A shorter section of base slide plate 28*a* is shown in affixure on building 14 as a plurality of such slide plates are secured in coactive alignment with base slide plates 28. Slide plates 28*a* are secured between inner base hold down strip 20 and outer base plate 32 by means of a plurality of masonry fasteners 30. A plurality of adjusting screws 34 are provided through base member slide plates 28 and 28*a* to provide adjustment of the slide plates relative to the facing of the respective buildings 12 and 14. Adjusting screws 34 merely butt against the building facing to set the planar relationship of the slide plates 28 thereto.

Figure 2:
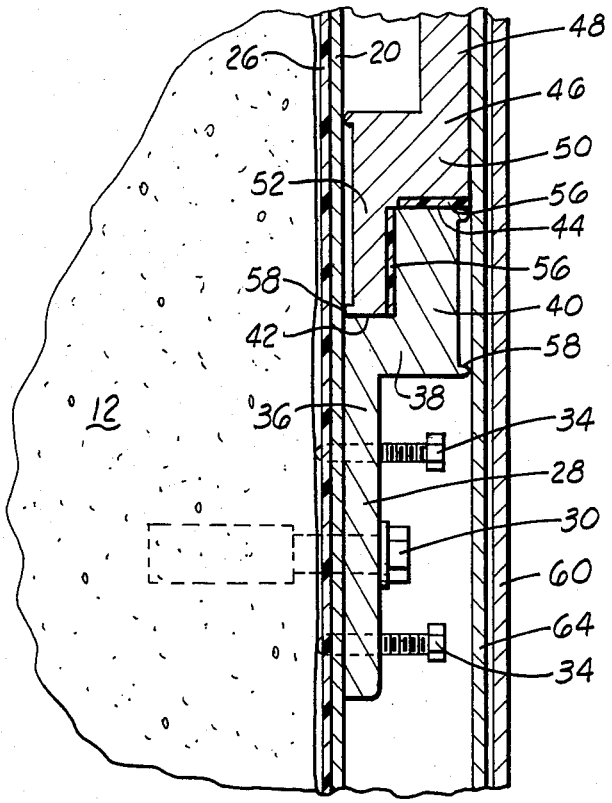
FIG. 2 is a partial vertical cross-section of the exterior expansion joint assembly of FIG. 1.

Referring also to FIG. 2, the slide plates 28, 28*a* are formed to include a foot plate portion 36 as unitarily formed into a right angle flanged shoulder 38 extending into a guide plate portion 40 and defining a slideway 42 therein. The upper edge of guide plate portion 40 serves as a slide support surface 44 which functions in supporting contact with upper cover slide plates 46 and 46*a*, to be described. The upper slide plates 46, 46*a* are similarly formed to include a foot plate portion 48, right angle flanged shoulder 50 and guide plate 52 defining a slide surface 54 in supported, sliding contact with support surface 44 of the base slide plates 28, 28*a*. Each of slide surface 54 and support surface 44 are preferably lined with teflon tape 56 (FIG. 2) to provide increased slidability as between the two members. Ridging structure 58 (FIG. 2) may be included on the guide plates to reduce frictional contact.

The cover structure of assembly 10 consists of outer cover plates 60 and 62 disposed in overlapping, sliding relationship adjacent inner cover plate 64. The inner cover plate 64 is formed as by welding and the like to be a right angle plate as formed by continuous panels 66 and 68. The panels 66, 68 may be formed as an end-to-end plurality of uniform length sections, e.g. 8 to 10 feet, butt-joined and welded by a cover splice plate 70 on the inner or blind side. In like manner, the continuous outer panels 60 and 62 are each formed by a plurality of end-to-end, butt-joined panels 70, 72 respectively, welded together by external cover splice plates 78, 80.

The outer cover plate 60 is bent to form a slide flange 82 which is adapted for engagement with base plate 32 and secured thereto by a plurality of metal fasteners 84, e.g. sheetmetal screws or the like, disposed along the height thereof. Thus, the fasteners 84 may be aligned on such as 6 to 12 inch centers with periodic fasteners 86 being secured through the front cover face at selected periodic spacings. The other side cover plate 62 is similarly secured to its respective base plate 32 by fasteners 84 and front fasteners 86 as periodically placed. The inner cover plate 64 is supported by a weld affixure as inner cover panel 66 is welded to foot plate 48 of cover slide plate 46 and right angle panel 68 is weld secured to foot plate 48 of cover slide plate 46*a*. Thus, the inner cover plate 64 is supported on opposite sides as the associated slide plates 46 and 46*a* are hung in sliding disposition within base member slide plates 28 and 28*a*, respectively, and movements of the adjacent building structures 12 and 14 along the axes indicated by arrows 16 and 18 will effect reciprocation of inner cover plate panels 66 and 68 relative to the respective outer plate cover panels 60 and 62. Outwardly the assembly presents a uniform corner facing which may be finished with selected decor.

It may be readily noted that the sway tolerances of the particular building structures being joined will dictate the width of the respective slide plate assemblies and their associated cover plate members.

Figure 3:
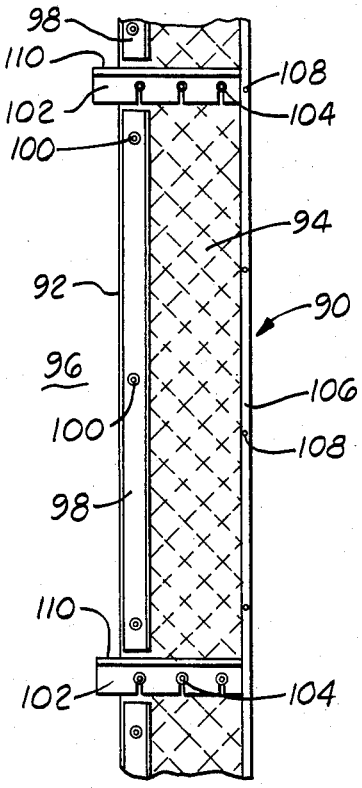
FIG. 3 is a view in elevation of a portion of building hanger structure of the present invention.

FIG. 3 illustrates an alternate form of base plate assembly 90 that may be utilized in the present invention. The base plate assembly 90 is disposed on a building adjacent to an expansion edge 92 as it provides all essential base member structure in overlay of gutter sheeting 94, BFG vinyl sheeting. Gutter sheeting 94 is secured to extend in to line the adjacent expansion void 96. The sheeting 94 is secured by a plurality of periodically aligned base strips 98 disposed along the edge of expansion void 96 and secured therealong by means of a plurality of spaced masonry fasteners 100.

A plurality of base member slide plates 102 are placed horizontally between each adjacent pair of base strips 98 and secured by means of a plurality of masonry fasteners 104. A base plate 106 formed of channel, angle or special extrusion, is disposed continuously in vertical disposition and securing the ends of respective base slide plates 102 as base plate 106 is secured by a plurality of spaced masonry fasteners 108. The base plate 106 serves to sealingly secure gutter sheeting 94 as well as to tie together the plurality of parallel-spaced base member slide plates 102. The strips 98 seal the assembly to the expansion edge of the building adjacent void 96, but need not retain contact with base member slide plates 102. Base slide plates 102, having respective top slide channel formations 109 are then free to receive associated cover slide plates and cover structure (not shown).

Figure 4:
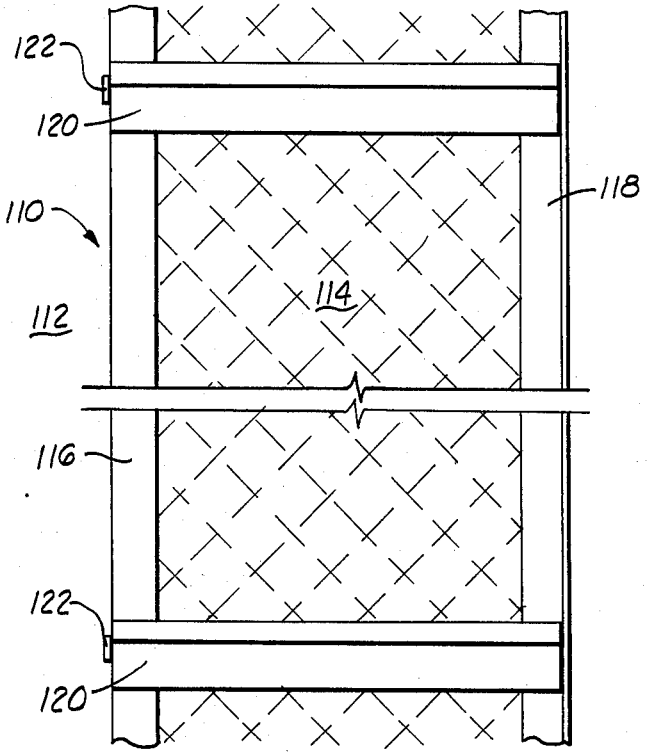
FIG. 4 is a view in elevation of a portion of an alternate form of building hanger structure.

FIG. 4 illustrates still another alternative base member assembly 110 which is particularly desirable for use during installation of such expansion joint assemblies on very tall building structures. Assembly 110 is installed in disposition adjacent a building expansion void 112 as vinyl gutter liner 114 is secured against the supporting building. The base assembly 110 is constructed so that it can be put up in a series of preassembled ladder-like sections of specified length, e.g. 12 feet. Assembly 110 consists of strip channel assembly 116 adapted for securing on the building structure corner and a parallel-disposed base plate, angle or extrusion 118. A plurality of successive, spaced base member slide plates 120 are then secured as by welding to base member 118 while the respective inner ends are lightly secured by such as sheet metal screws to a tang 122 secured on the outside of inner base plate 116. This allows some freedom in handling, the aligning the base member assemblies 110 until positioned on the building, whereupon suitable masonry fasteners (not shown) secure all of strip channels 116, base plates 118 and slide plates 120 in permanent affixure and operational position.

Figure 5:
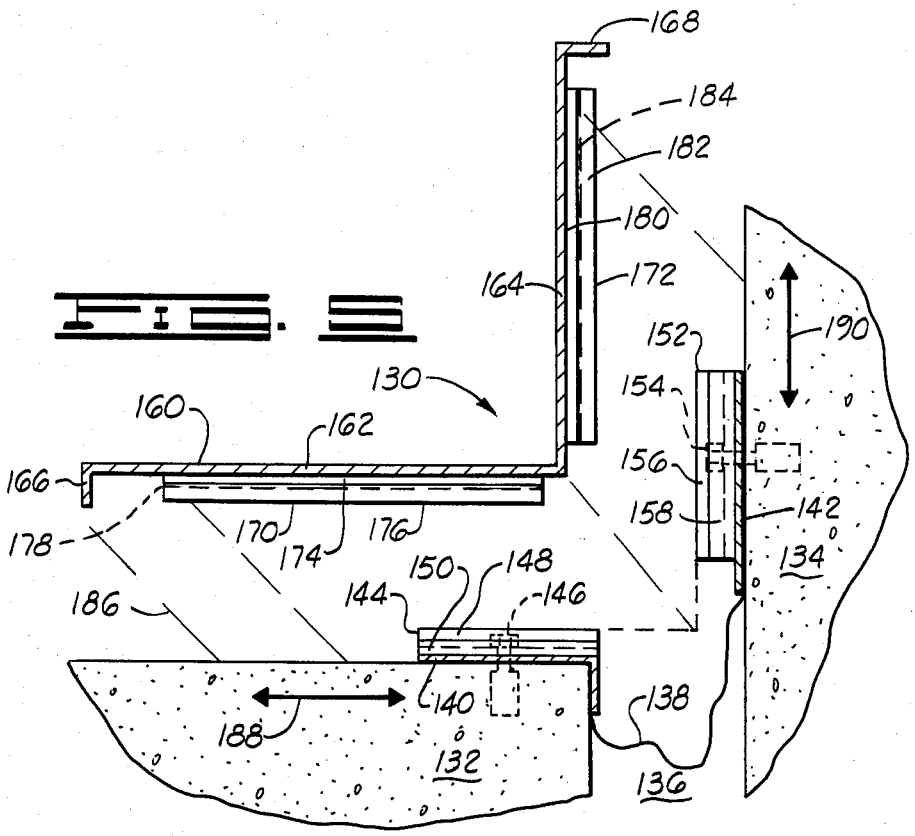
FIG. 5 is a top plan view of a concealed mount expansion joint assembly as constructed in accordance with the invention.

Referring to FIG. 5, there is shown another form of expansion cover assembly, a concealed mount assembly 130. The assembly 130 is installed between adjacent building structures 132 and 134 to cover the expansion void 136. A vinyl gutter sheeting 138 is secured across void 136 as it is fastened beneath a base plate 140, plate or channel member, on the corner of structure 132, and beneath a base plate 142 on the adjoining building structure 134. Base plate 140 includes a base member slide plate 144 secured thereon by open or more spaced masonry fasteners 146, depending on requisite length. The base slide plate 144 is of similar construction as previously disclosed as it includes a foot plate and an upwardly extending flanged shoulder 148 defining a slide channel 150 adjacent base plate 140. In like manner, an opposite side base member slide plate 152 is secured against base plate 142 by means of a plurality of masonry fasteners 154, and slide plate 152 also includes a foot plate and flanged shoulder 156 defining a slide channel 158.

A continuous right-angle cover plate 160 is shown removed in exploded form from the building mounting. Thus, cover plate 160 is formed to include opposite side panels 162 and 164 which include respective outer flanges 166 and 168. The opposite side panels 162 and 164 are movably supported by respective cover slide plates 170 and 172 secured on the rear side of cover plate 130. Each of the cover slide plates is similarly formed in the manner as previously described. That is, cover slide plate 170 includes a mounting foot plate 174 extending into a downwardly directed flanged shoulder 176 that defines a slide channel 178 adjacent cover panel 162. In like manner, cover slide plate 172 is formed to include foot plate 180, downwardly directed shoulder 182 and slide channel 184.

Operative positioning of assembly 130 sees cover plate 160 moved along the projection lines 186 to a position adjacent the adjoining building structures 132 and 134 with cover plate flanged shoulder 176 slidingly received down within slide channel 150 and opposite side flanged shoulder 182 received down within slide channel 158. Movement of building structures 132 and 134 in the respective directions of arrows 188 and 190, as caused by wind sway, seismic reaction, temperature adjustments, etc., allow the cover assembly 130 to remain in close sliding engagement to the respective structures as the cover slide plates 170 and 172 reciprocate relative to the respective base slide plates 144 and 152. The cover assembly 130 may be disposed along any of selected heights as the structure is laid up in sections of selected length. Thus, a plurality of the respective base slide plates 144 and 152 are fastened in position upward along the building structures 132 and 134, respectively, at whatever the selected spacings. In like manner, the cover assembly 130 may be assembled in sections with cover plate splices welded in as shown in FIG. 1, and pluralities of cover slide plates 170 and 172, each having spacing similar to their respective base slide plates 140 and 142, are secured upward therealong. Cover flanges 166 and 168 serve to conceal the entire assembly for aesthetic effect.

Figure 6:
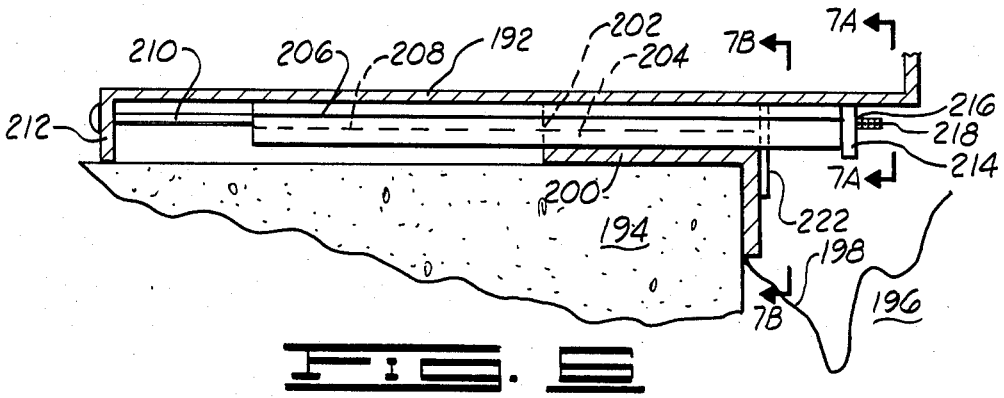
FIG. 6 is a horizontal section view of a portion of concealed mount expansion joint as constructed in the manner of FIG. 5 and including a section of cover panel mounted thereon in interlocked engagement.

FIG. 6 illustrates a portion of a cover plate 192 that includes a safety device for preventing accidental release or falling away of the cover plate. Thus, a building 194 adjacent and expansion void 196 includes the usual vinyl gutter 198 as secured beneath a base plate channel member 200 secured to structure 194. Base plate 200 supports a base slide plate 202 defining an upwardly directed slide channel 240. The cover plate 192 includes a cover slide plate 206 that includes a downwardly directed channel and slide flange 208 that rides in sliding engagement within slide channel 204. In order to ensure that cover slide plate 206 cannot become upwardly dislodged from lower base slide plate 202, an elongated retaining bolt 210 is secured through flange 212 of cover 192 and a block 214 secured as by welding adjacent the inner edge of cover slide plate 206. Block 214 includes a threaded bore 216 for receiving a threaded end 218 of bolt 210 in secure engagement. Retaining bolt 210 is secured with sufficient clearance beneath base slide plate 202 to allow for vertical expansion.

Figure 7B:
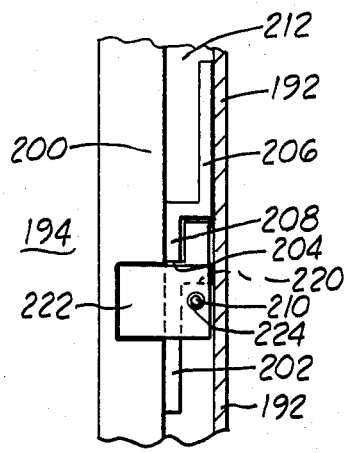
FIG. 7B is a section taken along lines 7B—7B of FIG. 6.
Figure 7A:
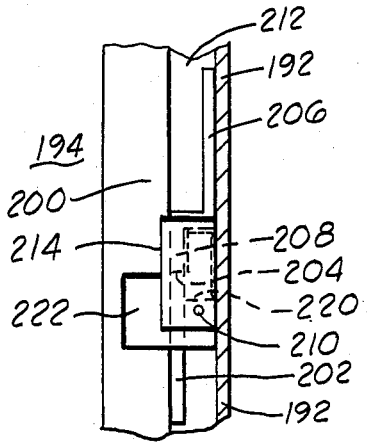
FIG. 7A is a section taken along lines 7A—7A of FIG. 6.

Referring also to FIGS. 7A and 7B, it may be seen that the bolt 210 as threadedly secured between cover flange 212 and cover block 214 extends just beneath the flanged shoulder 220 of base slide plate 202 thereby to prevent disengagement between flanged portions of respective base and cover slide plates 202 and 206. That is, bolt 210 is secured too close to flanged shoulder 220 to allow removal of flange 208 from the slide way.

Along a vertical expanse of such cover assembly, where for example there may be a base/cover slide assembly every three feet, and the cover paneling is laid up in 10 to 12 foot sections, it is only necessary to place a securing bolt 210 periodically, e.g. at the top slide assembly for each vertical cover section. Referring specifically to FIG. 7B, yet another guide plate 222 may be secured as by welding to base plate 194, plate 222 including a hole 224 receiving bolt 210 therethrough and positively locking the cover 192 to the base plate 194 in sliding fashion.

Figure 8:
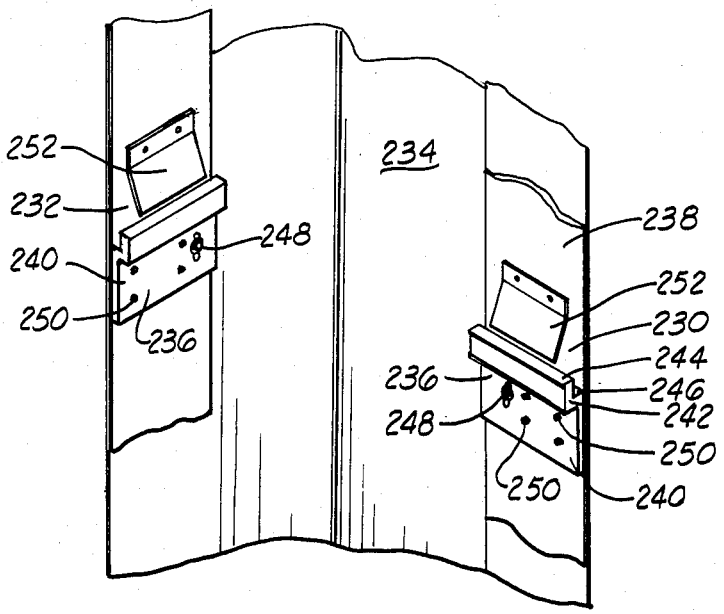
FIG. 8 is a view in perspective of a portion of still another alternative form of building hanger structure.

FIG. 8 illustrates another form of interlocking base member slide plate assembly that may be used with a cover assembly such as that of FIG. 5. Thus, base slide plate assemblies 230 and 232 are disposed along opposite sides of a structural void while securing vinyl gutter 234 therebetween. Each of the base slide plate assemblies may be of identical construction, e.g. including a base slide plate 236 and base plate 238 as sealingly secured along vinyl gutter 234. Base slide plate 236 includes foot plate 240 extending into flanged shoulder 242 and flange 244 defining slide way 246. Each slide plate 236 is secured to the adjacent structure by means of a masonry fastener 248 and it is adjusted as to level and orientation by a plurality of adjustment screws 250. Interlock of cover structure is effected by means of spring plates 252, each of which is secured as by welding or other fasteners to base plate 238 to extend a bent portion over slide way 246. Thus, when the cover plate assembly is snapped into place over flange 244, the spring 252 will snap outward thereby to capture the shoulder of the mating cover slide plate therebeneath. As in the case with the locking bolt securing structure, such safety springs need only be used on selected, spaced cover/base slide plate assemblies along the height of the structure.

Figure 9:
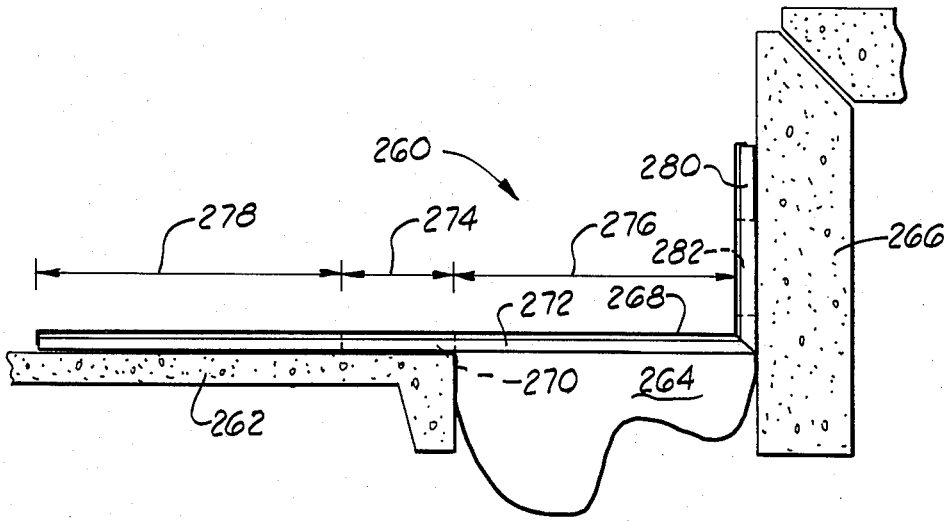
FIG. 9 illustrates in generally schematic form the functional relationship of a concealed mount assembly.

FIG. 9 illustrates a concealed mount cover assembly 260 of a type that is constructed to provide for major void change on a first axis with but minor shift on the axis normal thereto. Thus, building structure 262 reflects a relatively large sway relative to a void space 264 while the adjacent building structure 266 may experience relatively little movement. Thus, a unitary, right angle cover plate 268 is supported on one side as base slide plate 270 supports a very long cover slide plate 272 thereon. Noting the arrows, the distance of support indicated by arrow 274 is much less than either the limit of inward movement 276 or extent of outer movement 278. The opposite side of cover plate 268 is supported by cover slide plate 280 sliding on a base slide plate 282, and much less longitudinal adjustment is required.

Figure 10:
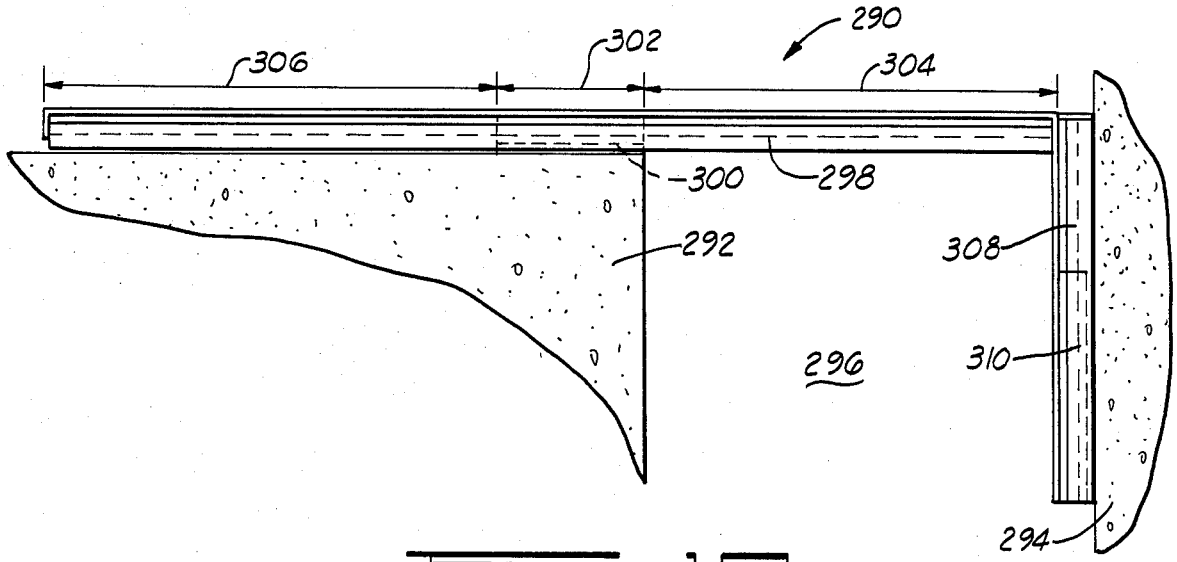
FIG. 10 illustrates another form of concealed mount assembly.

FIG. 10 illustrates yet another form of concealed mount cover assembly 290 wherein but a single surface is exposed or presented to the exterior view. Thus, cover assembly 290 is installed between adjacent building structures 292 and 294 defining an expansion void 296 as shown in its normal joint opening position. Cover slide plate 298 rides in engagement on base slide plate 300 through a relatively narrow support portion indicated by arrow 302 while inward and outward movement shown by arrows 304 and 306, respectively, is much larger. Lateral movement of building 294 normal arrow 304 may be effected up to the limit imposed by an interior cover slide plate 308 moving relative to the underlying base slide plate 310 secured to building structure 294. The usual vinyl gutter liner and other securing and adjusting hardware may be used similarly in the cover assembly 290.

Figure 11:
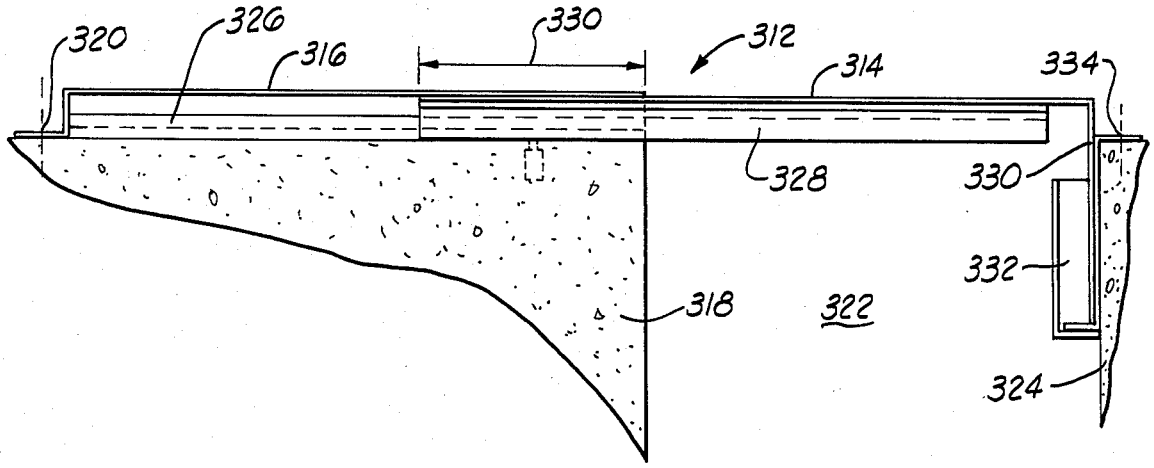
FIG. 11 illustrates still another exterior building joinder expansion assembly of the flush mount type.

FIG. 11 illustrates yet another alternative form of flush mount wind sway expansion joint cover assembly 312 having interiorly oriented transverse slide function. In this case, the flush mount cover includes a cover plate 314 functioning in coaction with a base cover plate 316 as secured to building structure 318 by fasteners at designation 320. The cover plate 314 reaches extendably across expansion void 322 to the adjacent building structure 324. The usual gutter assembly and fastening techniques would be employed as a base member slide plate 326 coacts to support a cover slide plate 328, the support or contact portion being indicated by arrow 330. The interiorly extending end of cover plate 324, panel portion 330, may simply be extended into a short receptacle portion 332 as secured at 334; however, if lateral sway of building structure 324 is greater, opposing slide plate support such as that utilized for the interior portion of the cover in FIG. 10 may be utilized.

The foregoing discloses novel three-dimensional expansion joint cover structure that provides effective concealment of larger expansion joints and allows coordination with various architectural material and configurations. Expansion joints constructed in accordance with the present invention are particularly desirable for use in exterior expansion joint applications and such cover assemblies adapt well with attendant architectural materials as may be employed on diverse building joinders, corners, facings and the like.

Changes may be made in combination and arrangement of elements heretofore set forth in the specification and shown in the drawing; it being understood that changes may be made in the embodiments disclosed without departing from the spirit and scope of the invention as defined in the following claims.

What is claimed is:

1. An expansion joint cover assembly for enclosing a void between orthogonally aligned movable surfaces, comprising:

first base slide means defining a slideway secured to the surface on one side of said void;

second base slide means defining a second slideway secured to the surface on the other side of said void at a right angle to said first base slide means;

first cover slide means slidingly engaged in and supported by said first base slide means;

second cover slide means slidingly engaged in and supported by said second base slide means; and cover plate means formed as first and second panels disposed at a right angle with said first panel secured to said first cover slide means and said second panel secured to said second cover slide means.

2. An assembly as set forth in claim 1 which further includes:

first base cover plate means secured with said first base slide means to extend over an outer portion of said cover plate means first panel in close proximity thereto; and second base cover plate means secured with said second base slide means to extend over an outer portion of said cover plate means second panel in close proximity thereto.

3. An assembly as set forth in claim 2 which further includes:

expansible waterproof means secured over said expansion void between said first and second slide means.

4. An assembly as set forth in claim 3 which further includes:

first base strip means secured along the void one side to secure said expansible waterproof means; and second base strip means secured along the void other side to secure said expansible waterproof means.

5. An assembly as set forth in claim 2 wherein:

a plurality of first and second base slide means are secured in spaced relationship; and a plurality of first and second cover slide means are secured in said spaced relationship for mating engagement with said respective base slide means.

6. An assembly as set forth in claim 1 which further includes:

expansible waterproof means secured over said expansion void between said first and second slide means.

7. An assembly as set forth in claim 6 which further includes:

first base strip means secured along the void one side to secure said expansible waterproof means; and second base strip means secured along the void other side to secure said expansible waterproof means.

8. An assembly as set forth in claim 1 wherein:

a plurality of first and second base slide means are secured in spaced relationship; and a plurality of first and second cover slide means are secured in said spaced relationship for mating engagement with said respective base slide means.

9. An assembly as set forth in claim 1 wherein said first and second base slide means each comprise:

base plate means secured at selected spacing from the void;

strip means secured parallel thereto and adjacent said void; and base slide plate means secured normal between said base plate means and said strip means, said base slide plate means being formed into a foot plate extending into a flanged shoulder defining said slideway adjacent a guide plate portion.

10. An assembly as set forth in claim 9 wherein said first and second cover slide means each comprise:

cover slide plate means formed as a foot plate for secure affixure to said cover plate means, said foot plate extending into a flanged shoulder and a reverse flanged guide plate portion for sliding retention within said respective base slide plate means slideway.

11. An assembly as set forth in claim 10 which further includes:

first base cover plate means secured to said first base plate means and extending in close proximity over a portion of said cover plate means first panel; and second base cover plate means secured to said second base plate means and extending in close proximity over a portion of said cover plate means second panel.

12. An assembly as set forth in claim 9 which further includes;

expansible waterproof means secured over said void between strip means of said first and second base slide means.

13. An assembly as set forth in claim 1 which further includes;

first and second base plate means secured adjacent said expansion void and supporting said first and second base slide means thereon; and expansible waterproof means sealing secured beneath said first and second base plate means and extending therebetween.

14. An assembly as set forth in claim 1 which further includes:

retention means preventing disengagement of said first and second cover slide means from respective first and second base slide means.

15. An assembly as set forth in claim 14 wherein said retention means comprises:

removable bolt means secured across said cover plate means parallel to said respective cover slide means to limit vertical movement of said cover plate means relative to said respective base slide means.

16. An assembly as set forth in claim 14 wherein said retention means comprises:

spring means secured to said base slide means adjacent said slideway to extend in clearance interference thereby to limit vertical movement of said cover slide means relative thereto.

17. An expansion joint cover assembly for enclosing a void between generally orthogonally movable adjoining building structures, comprising:

cover plate means consisting of first and second panels joined at an angle, said cover plate means being positioned to extend vertically with said first and second panels adjacent respective building structures to cover the void;

first and second cover slide means secured to respective first and second panels, each defining a downwardly oriented guide plate; and first and second slide means secured to the respective structures and connected to slidably retain respective guide plates of said first and second cover slide means.

18. An assembly as set forth in claim 17 which further includes:

first and second base cover means secured to respective structures to extend over said respective first and second panels of the cover plate means in close proximity thereto.

19. An assembly as set forth in claim 18 which further includes:

expansible waterproof means secured over said void between said first and second slide means.

20. An assembly as set forth in claim 17 which further includes:

expansible waterproof means secured over said void between said first and second slide means.

21. An assembly as set forth in claim 17 wherein:

a plurality of first and second slide means are secured in spaced relationship along the respective structures.

22. An assembly as set forth in claim 21 which further includes:

first and second elongated base plates secured along said respective structures with each securely supporting a plurality of said respective first and second slide means.

* * * * *